US012428801B2

(12) United States Patent
Smith, Jr.

(10) Patent No.: US 12,428,801 B2
(45) Date of Patent: Sep. 30, 2025

(54) VARIABLE GRIP GRAPPLE

(71) Applicant: Curtis Industries, LLC, West Boylston, MA (US)

(72) Inventor: Steven D. Smith, Jr., Templeton, MA (US)

(73) Assignee: Curtis Industries, LLC, West Boylston, MA (US)

( * ) Notice: Subject to any disclaimer, the term of this patent is extended or adjusted under 35 U.S.C. 154(b) by 892 days.

(21) Appl. No.: 17/652,150

(22) Filed: Feb. 23, 2022

(65) Prior Publication Data

US 2022/0267987 A1 Aug. 25, 2022

Related U.S. Application Data

(60) Provisional application No. 63/152,535, filed on Feb. 23, 2021.

(51) Int. Cl.
*E02F 3/40* (2006.01)
*E02F 3/413* (2006.01)

(52) U.S. Cl.
CPC ..... *E02F 3/404* (2013.01); *E02F 3/4133* (2013.01); *E02F 3/4135* (2013.01); *E02F 3/4136* (2013.01)

(58) Field of Classification Search
CPC ..... E02F 3/404; E02F 3/4133; E02F 3/4135; E02F 3/4136
USPC ..... 414/739, 729
See application file for complete search history.

(56) References Cited

U.S. PATENT DOCUMENTS 2,875,913 A * 3/1959 Gohrke ..... B66F 9/18 269/107
2,979,212 A * 4/1961 Dragonuk ..... F41A 9/87 414/428
3,243,067 A * 3/1966 Artman ..... E02F 3/401 37/406
3,375,595 A * 4/1968 Beltrami ..... E02F 3/4133 37/406
3,972,097 A * 8/1976 Schakat ..... E02F 3/404 414/722
4,023,848 A 5/1977 Bennett
4,358,147 A 11/1982 Hungerford
4,367,891 A * 1/1983 Wauer ..... B25J 15/0009 294/902

(Continued)

FOREIGN PATENT DOCUMENTS

CN 201710223730 5/2017
GB 1241818 8/1971

*Primary Examiner* — Christopher J Sebesta
*Assistant Examiner* — Audrey L Lusk
(74) *Attorney, Agent, or Firm* — Fish & Richardson P.C.

(57) ABSTRACT

The subject matter of this specification can be embodied in, among other things, a grapple assembly that includes a grapple unit having a fixed assembly, an articulating assembly having a pivot point located at a proximal end of the articulating assembly, pivotably coupling the articulating assembly to the fixed assembly, and an articulation connection point distal to the pivot point along the articulating assembly, and a linear actuator having a first actuator end and a second actuator end configured to move linearly relative to the first actuator end, the first actuator end being pivotably coupled to the fixed assembly and the second actuator end being pivotably coupled to the articulation connection point, and configured to actuate the articulating assembly relative to the fixed assembly.

11 Claims, 10 Drawing Sheets

(56) References Cited

U.S. PATENT DOCUMENTS

| | | | | |
|---|---|---|---|---|
| 4,858,346 | A * | 8/1989 | Schulte | B66C 3/02 37/903 |
| 4,925,359 | A * | 5/1990 | Dunnegan | E02F 3/404 414/722 |
| 5,971,455 | A * | 10/1999 | Wolin | B66C 3/16 414/739 |
| 6,012,895 | A | 1/2000 | Smith et al. | |
| 6,074,160 | A * | 6/2000 | Brumbaugh | E02F 3/3609 37/903 |
| 6,260,902 | B1 * | 7/2001 | Synnelius | B25J 15/08 294/902 |
| 6,336,786 | B1 | 1/2002 | Domann | |
| 7,117,951 | B2 * | 10/2006 | Stevens | A01B 43/00 171/135 |
| 7,818,901 | B2 * | 10/2010 | Zeno | E02F 3/404 37/406 |
| 8,069,591 | B2 * | 12/2011 | Dunn | E02F 3/401 37/406 |
| 9,611,618 | B2 | 4/2017 | Miller | |
| 9,790,059 | B2 | 10/2017 | Grant et al. | |
| 10,233,612 | B2 * | 3/2019 | Perry | E02F 3/962 |
| 2009/0290966 | A1 * | 11/2009 | King | E02F 3/404 414/739 |
| 2012/0151808 | A1 * | 6/2012 | Seda | E02F 3/96 37/406 |

* cited by examiner

VARIABLE GRIP GRAPPLE

CROSS-REFERENCE TO RELATED PATENT APPLICATIONS

This application claims the benefit of priority to U.S. Provisional Application 63/152,535, filed Feb. 23, 2021, the contents of which are incorporated by reference herein.

TECHNICAL FIELD

This instant specification relates to tractor attachments and relates more particularly to a tractor attachment and to a tractor attachment kit.

BACKGROUND

Tractors are powerful motor vehicles commonly used in, for example, agriculture, landscaping, and construction to perform a variety of moving, lifting, and other tasks. To perform such tasks, various types of specialized attachments are typically coupled to the tractor. One such specialized tractor attachment is a bucket, the bucket being coupled to the front end of the tractor using an assembly commonly referred to as a loader boom. One common type of loader boom comprises a pair of arms and a pair of mounts. The rear end of each arm is pivotally mounted on the tractor, and a mount is pivotally mounted on the front end of each arm. The bucket, in turn, is typically mechanically coupled to the pair of mounts. Pivotal movement of the arms relative to the tractor is typically provided by a first hydraulic mechanism, and pivotal movement of the mounts relative to the arms is typically provided by a second hydraulic mechanism. In this manner, the bucket may be raised or lowered by operation of the first hydraulic mechanism, and the bucket may be angularly adjusted by operation of the second hydraulic mechanism.

SUMMARY

In general, this document describes tractor attachments, more particularly to a tractor attachment and to a tractor attachment kit.

In an example embodiment, a grapple assembly includes a grapple unit that includes a fixed assembly, an articulating assembly having a pivot point located at a proximal end of the articulating assembly, pivotably coupling the articulating assembly to the fixed assembly, and an articulation connection point distal to the pivot point along the articulating assembly, and a linear actuator having a first actuator end and a second actuator end configured to move linearly relative to the first actuator end, the first actuator end being pivotably coupled to the fixed assembly and the second actuator end being pivotably coupled to the articulation connection point, and configured to actuate the articulating assembly relative to the fixed assembly.

Various embodiments can include some, all, or none of the following features. The articulating assembly can include a proximal segment comprising the articulation connection point, the pivot point at a first segment end, and a second pivot point at a second segment end opposite the first segment end, and a medial segment pivotably coupled to the second pivot point at a third segment end and extending to a fourth segment end. The articulating assembly can include a first linkage pivotably coupled to the fixed assembly at a first linkage end and pivotably coupled to the medial segment at a second linkage end opposite the first linkage end. The articulating assembly can include a distal segment having a fifth segment end pivotably coupled to a third pivot point at the fourth segment end, and extending to a sixth segment end opposite the fifth segment end, and a second linkage pivotably coupled to the first linkage at a third linkage end and pivotably coupled to the distal segment at a fourth linkage end opposite the first linkage end. The articulating assembly can be configured to be pivotably mounted on the fixed assembly at one of a first pivot point and a second pivot point, wherein mounting at the first pivot point can configure the articulated assembly to actuate at a faster closing speed relative to mounting at the second pivot point, and mounting at the second pivot point can configure the articulated assembly to actuate with a greater amount of force relative to mounting at the first pivot point. The grapple assembly can include a mounting unit removably affixed to the grapple unit and configured to removably mount the grapple unit on a tractor loader boom. The grapple assembly can include a mounting unit integrally formed with the grapple unit and configured to removably mount the grapple unit on a tractor loader boom. The mounting unit can include a frame, the frame having first and second rails and first and second brackets, the first and second brackets interconnecting the first and second rails and having structure complementary to the tractor loader boom, the grapple unit being removably mounted on the first and second rails. The fixed assembly can include a first portion and a second portion forming an L-shape, and the articulating assembly is pivotally mounted on the second portion of the fixed assembly at an end of the L-shape.

In an example implementation, a method for grappling includes actuating a first actuator end of a linear actuator linearly relative to a second actuator end, and actuating, by the linear actuator, an articulating assembly relative to a fixed assembly at a pivot point located at a proximal end of the articulating assembly, pivotably coupling the articulating assembly to the fixed assembly, the first actuator end being pivotably coupled to the fixed assembly and the second actuator end being pivotably coupled to an articulation connection point of the articulating assembly.

Various implementations can include some, all, or none of the following features. Actuating an articulating assembly relative to a fixed assembly at a pivot point located at a proximal end of the articulating assembly can include actuating, by the linear actuator, a proximal segment relative to the fixed assembly, the proximal segment comprising the articulation connection point, the pivot point at a first segment end, and a second pivot point at a second segment end opposite the first segment end, and actuating a medial segment relative to the proximal segment and the fixed assembly, wherein the medial segment is pivotably coupled to the second pivot point at a third segment end and extending to a fourth segment end. Actuating a medial segment relative to the proximal segment can include actuating, by the medial segment, a first linkage pivotably coupled to the fixed assembly at a first linkage end and pivotably coupled to the medial segment at a second linkage end opposite the first linkage end. Actuating an articulating assembly relative to a fixed assembly at a pivot point located at a proximal end of the articulating assembly can include actuating, by a second linkage, a distal segment having a fifth segment end pivotably coupled to a third pivot point at the fourth segment end, and extending to a sixth segment end opposite the fifth segment end, and actuating, by the first linkage, the second linkage, wherein the second linkage is pivotably coupled to the first linkage at a third linkage end and pivotably coupled to the distal segment at a fourth linkage end opposite the first linkage end. The method can include removably affixing the fixed assembly to a tractor loader boom of a tractor, and coupling the linear actuator to a controllable power source of the tractor. The method can include controllably providing power from a power source of a tractor to the linear actuator, wherein actuation of the linear actuator is based on receiving power controllably provided from the power source of the tractor.

The systems and techniques described here may provide one or more of the following advantages. First, a system can provide variably articulated grappling of payloads. Second, the system can provide a capability for lifting and hauling of objects, including but not limited to: logs, branches, brush, stones, rocks, yard waste, and construction debris. Third, the system can provide a capability for excavation of objects, including but not limited to rocks, roots, and debris. Fourth, the system can provide engagement with larger payload piles than can be engaged by traditional grapples. Fifth, the system can provide a capability for gripping of smaller objects than can be gripped by traditional grapples.

The details of one or more implementations are set forth in the accompanying drawings and the description below. Other features and advantages will be apparent from the description and drawings, and from the claims.

DETAILED DESCRIPTION

This document describes an attachment for a tractor or other type of power equipment. In general, the attachment is made up of multiple articulated segments that can grapple a payload in a manner that resembles a hand as it opens and closes to grasp an object.

Figure 1:
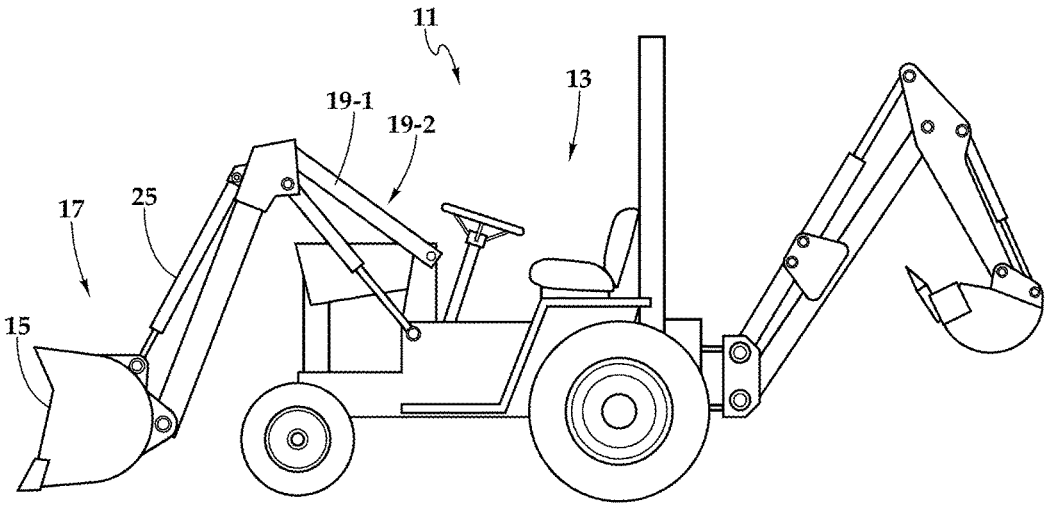
FIG. 1 is a front perspective view of a conventional tractor assembly.
Figure 2:
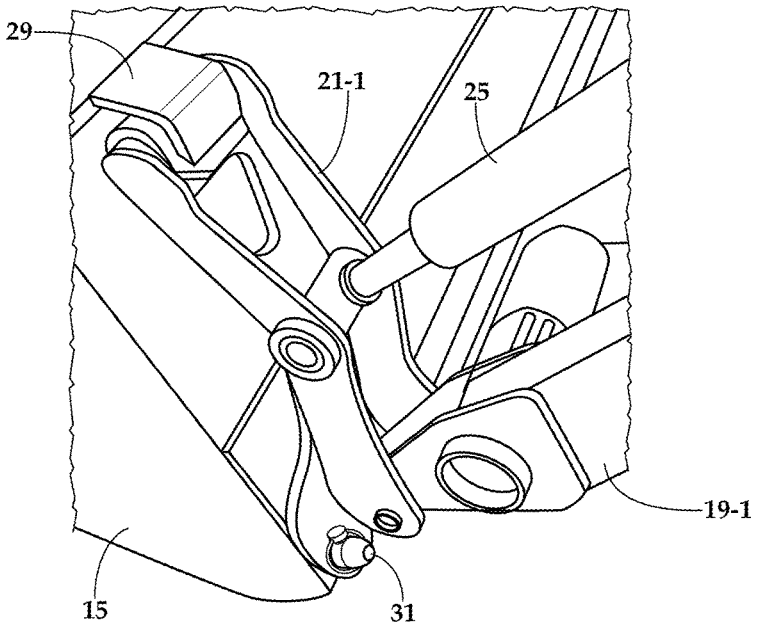
FIG. 2 is an enlarged, fragmentary, rear, perspective view of the conventional tractor assembly of FIG. 1.
Figure 4:
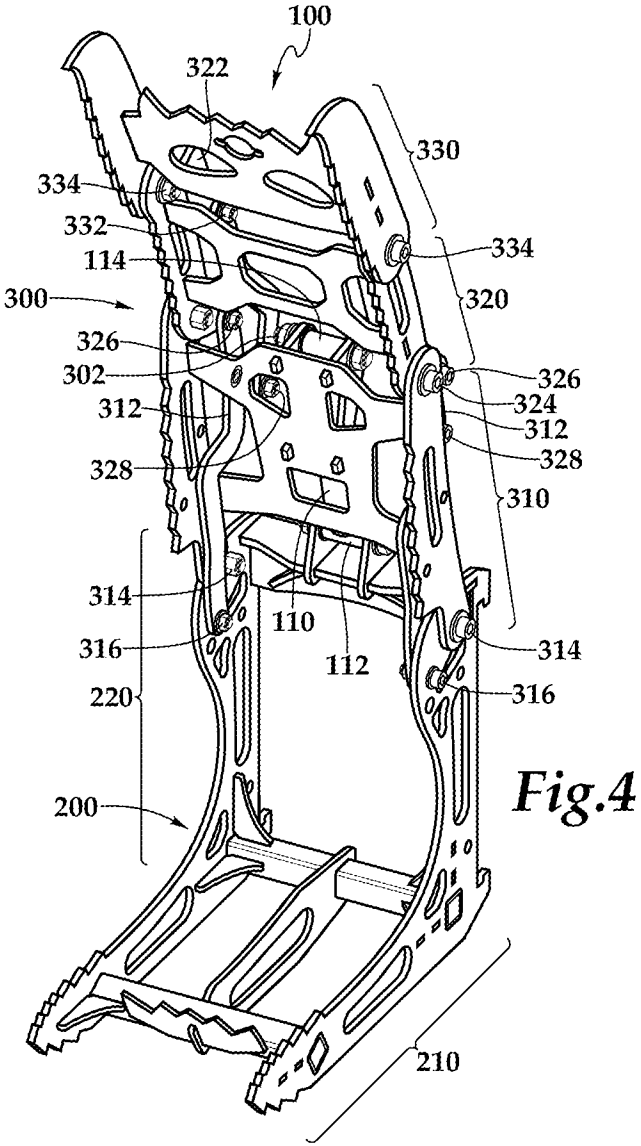
FIG. 4 is a front perspective view of an example grapple unit in an open configuration.
Figure 3:
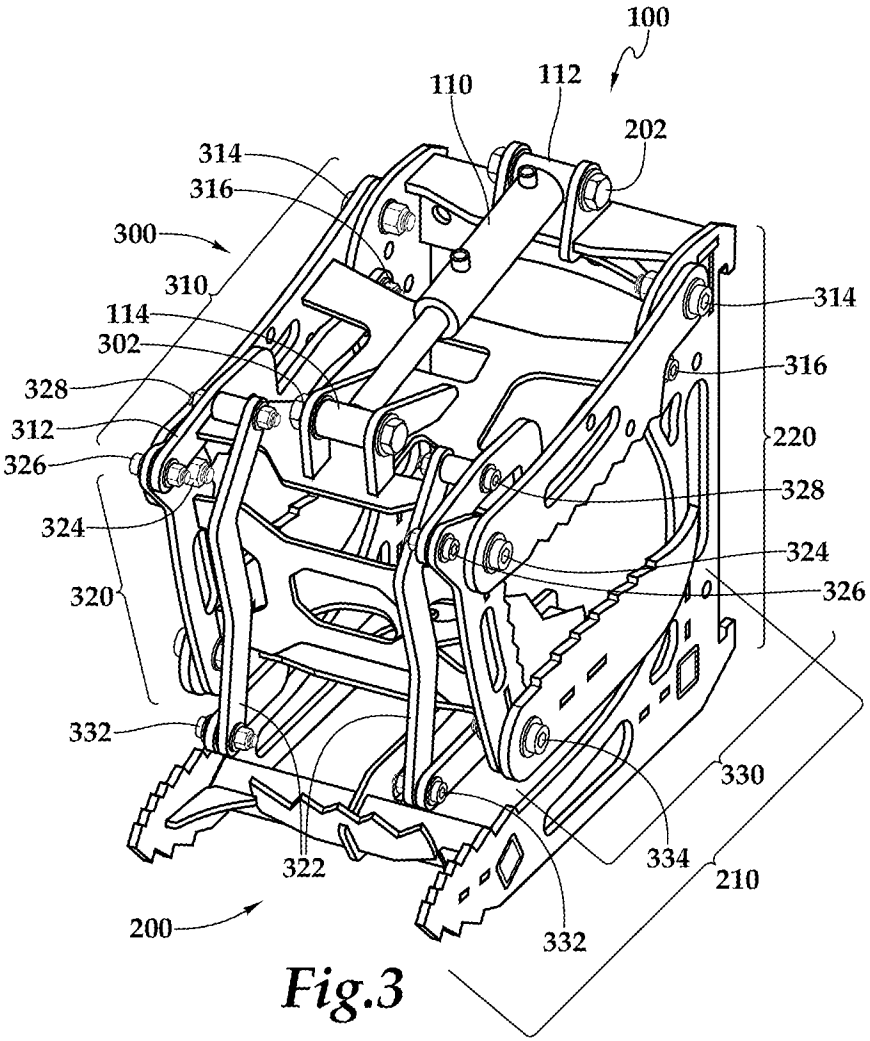
FIG. 3 is a front perspective view of a grapple assembly in a closed configuration.

Referring now to FIGS. 1 and 2, there are shown a front, perspective view and an enlarged, fragmentary, rear, perspective view of an exemplary conventional tractor assembly, the exemplary conventional tractor assembly being represented generally by reference numeral 11.

Tractor assembly 11 includes a tractor 13. Although tractor 13 is depicted in FIG. 1 as a four-wheeled motor vehicle, it is to be understood that tractor 13 need not be a four-wheeled motor vehicle and may, instead, comprise other types of vehicles (e.g., utility vehicles, forklifts, fork trucks).

Tractor assembly 11 additionally includes a bucket 15 and a loader boom 17. Loader boom 17 includes a pair of arms 19-1 and 19-2 and a pair of mounts 21-1 and 21-2. The arms 19-1 and 19-2 are pivotally mounted at their respective rear ends on the tractor 13. Pivotal movement of the arms 19-1 and 19-2 relative to the tractor 13 may be provided by a hydraulic mechanism comprising one or more hydraulic cylinders 23. Mounts 21-1 and 21-2 are pivotally mounted on the front ends of the arms 19-1 and 19-2, respectively. Pivotal movement of the mounts 21-1 and 21-2 relative to the arms 19-1 and 19-2 may be provided by another hydraulic mechanism comprising one or more hydraulic cylinders 25. The bucket 15 is mechanically coupled to the mounts 21-1 and 21-2. Such coupling is typically achieved by hooks on the rear of the bucket 15 that matingly fit over the top ends 23-1 and 23-2 of the mounts 21-1 and 21-2, respectively, and by pins extending from the rear of the bucket 15 that are received in pin holes 27-1 and 27-2 in the mounts 21-1 and 21-2, respectively. One such hook 29 and one such pin 31 are visible in FIG. 2.

Specific configurations of the loader boom, as well as the complementary structure on the bucket for attaching to the front end of the loader boom, can vary from one manufacturer or model to another.

As can be appreciated, there are situations in which it would be desirable to replace the functionality afforded by a bucket with the functionality afforded by another type of tractor attachment. As can also be appreciated, it would also be desirable to enable such a replacement to be made without requiring that changes be made to the loader boom. In other words, it would be desirable for the replacement attachment to be attachable to a conventional loader boom. Although some alternative attachments exist, some of these alternative attachments present certain shortcomings in terms of cost, weight, size, and/or variability in use.

FIGS. 3-10 show an example grapple unit assembly 100 from various perspectives and in various opening configurations. In general, the grapple unit assembly 100 is a variable grip grapple accessory that is configured to connect to front end loader arms on power implements such as compact and sub-compact tractors. The grapple unit assembly 100 allows operators to pick up, grip, & haul payloads such as brush, branches, logs, rocks, and other forms of debris. The design consists of a fixed assembly 200 (e.g., a lower jaw assembly) and one or more articulating assemblies 300 (e.g., upper clamping jaw assemblies). As may be seen in FIG. 7, the articulating assembly 300 is hingedly attached to the fixed assembly 200 and consists of a proximal segment 310, a medial segment 320, and a distal segment 330 hingedly attached to each other with mechanical linkages controlling their motion. The proximal segment 310 extends from a segment end 311*a* to a segment end 311*b*, the medial segment 320 extends from a segment end 321*a* to a segment end 321*b*, and the distal segment 330 extends from a segment end 331*a* to a segment end 331*b*.

Figure 8:
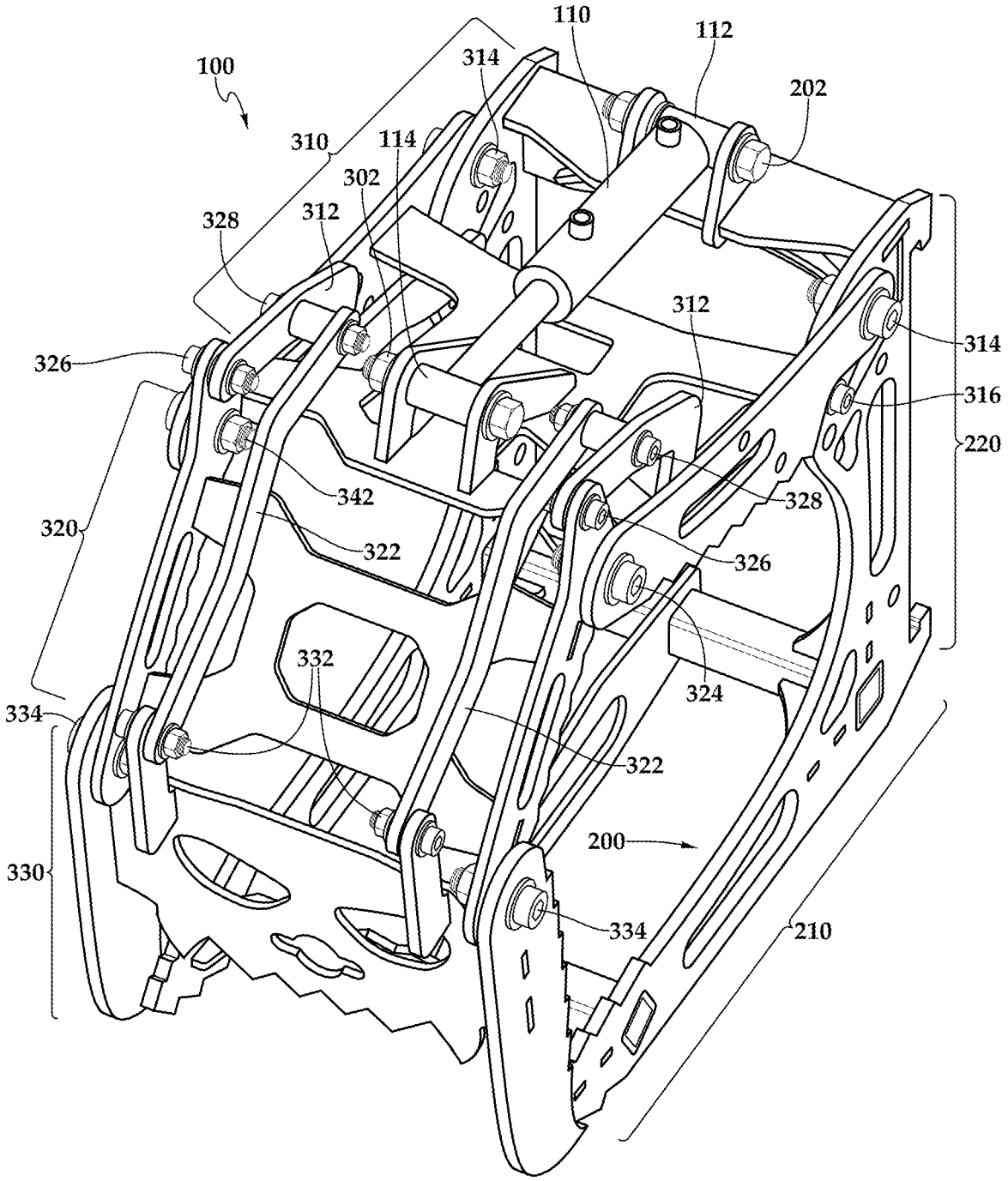
FIG. 8 is a front perspective view of the example grapple unit in a closed configuration.

As may be seen in FIG. 8, the fixed assembly 200 consists of a portion 210 (e.g., a portion that is oriented approximately parallel to the ground when in use) and a portion 220 (e.g., a portion that is oriented generally vertical to the ground when in use) that are arranged to form an L-shape. The articulating assembly 300 is pivotally mounted on the portion 220 of the fixed assembly 200 at an end of the L-shape (e.g., near the far upper end of the "L"). Many traditional sub-compact tractor grapples have an L-shaped upper jaw that pinches down on the ends of the lower jaw tines. This leaves a large hole between the lower jaw and the upper jaw when the grapple is fully closed. Objects that are not large enough to fill the gap are left unrestrained and may fall out of the jaws during transport. Furthermore, the use of L-shaped upper jaws restricts the maximum amount of opening of the grapple, limiting the amount of material that can be engaged.

The grapple unit assembly 100 is opened and closed by a linear actuator 110 (e.g., a double-acting hydraulic cylinder, an electromechanical linear actuator, a linear motor, a rotary-to-linear actuator) that is configured to actuate the articulating assembly 300 relative to the fixed assembly 200. The linear actuator 110 includes an actuator end 112 and an actuator end 114 configured to move linearly relative to the actuator end 112. The actuator end 112 is pivotably coupled to the fixed assembly 200 at a pivot point 202, and the actuator end 114 is pivotably coupled to an articulation connection point 302 on the proximal segment 310. In the illustrated example, the grapple unit assembly 100 includes only a single linear actuator 110, but in some embodiments any appropriate number of linear actuators 110 can be used.

In general, the grapple unit assembly 100 is configured such that mechanical linkages continuously vary the angle of the medial and distal segments with respect to the proximal segment as the linear actuator is extended. This allows the grapple unit assembly 100 to be wide open when the linear actuator 110 is retracted and closed like a human first when the linear actuator 110 is fully extended.

Figure 5:
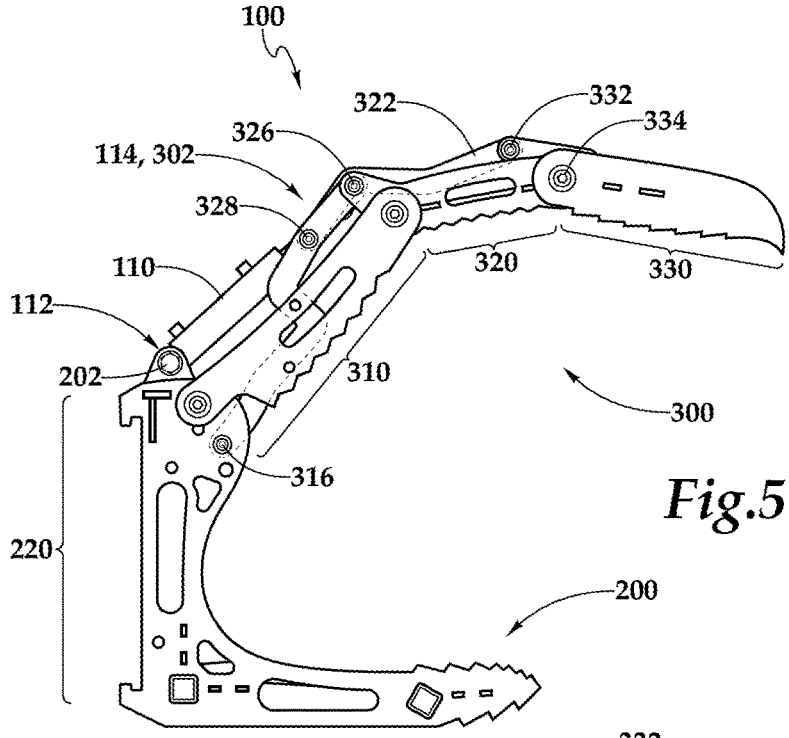
FIG. 5 is a side view of the example grapple unit in a partly open configuration.
Figure 6:
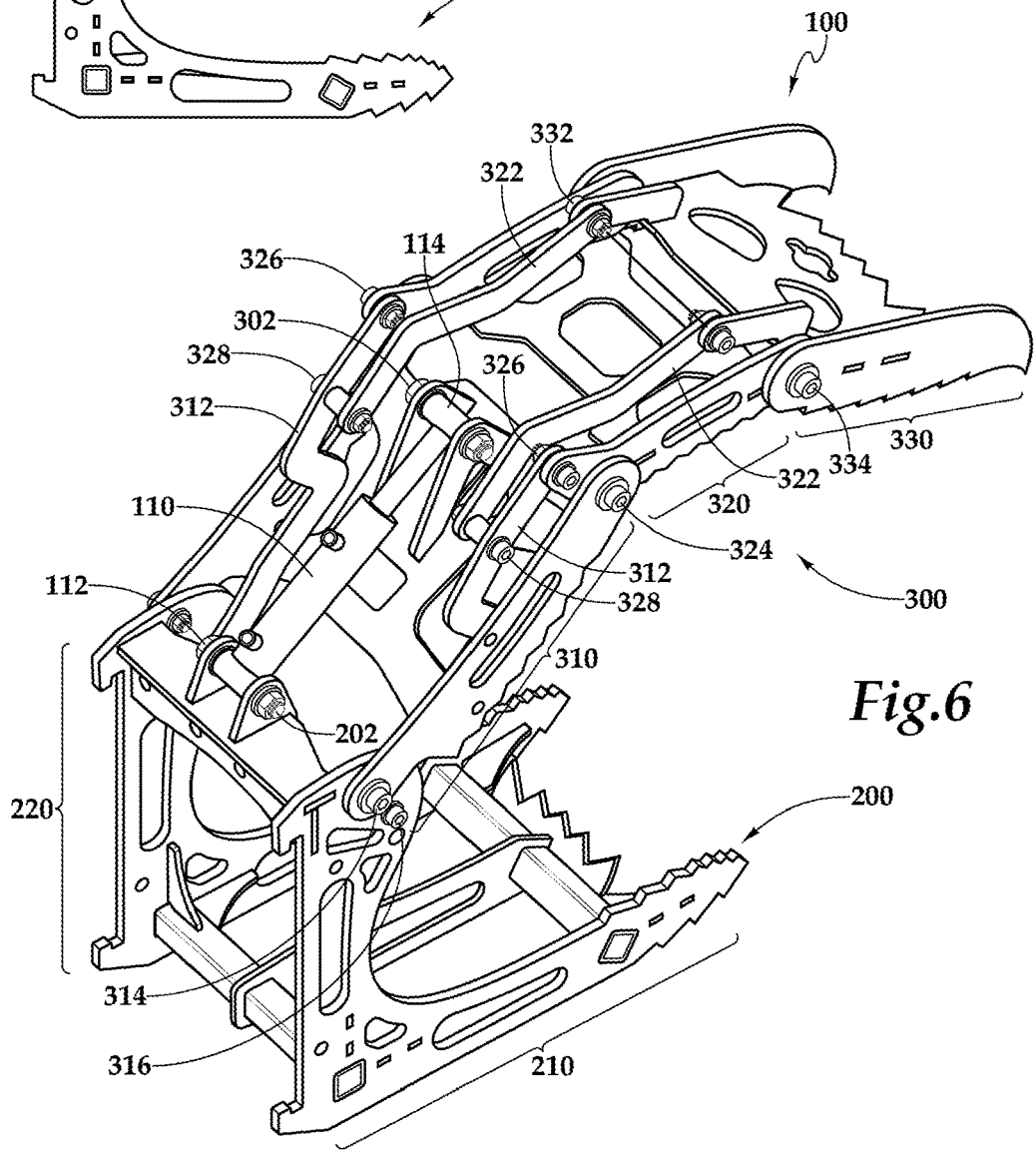
FIG. 6 is a rear perspective view of the example grapple unit in a partly open configuration.
Figure 7:
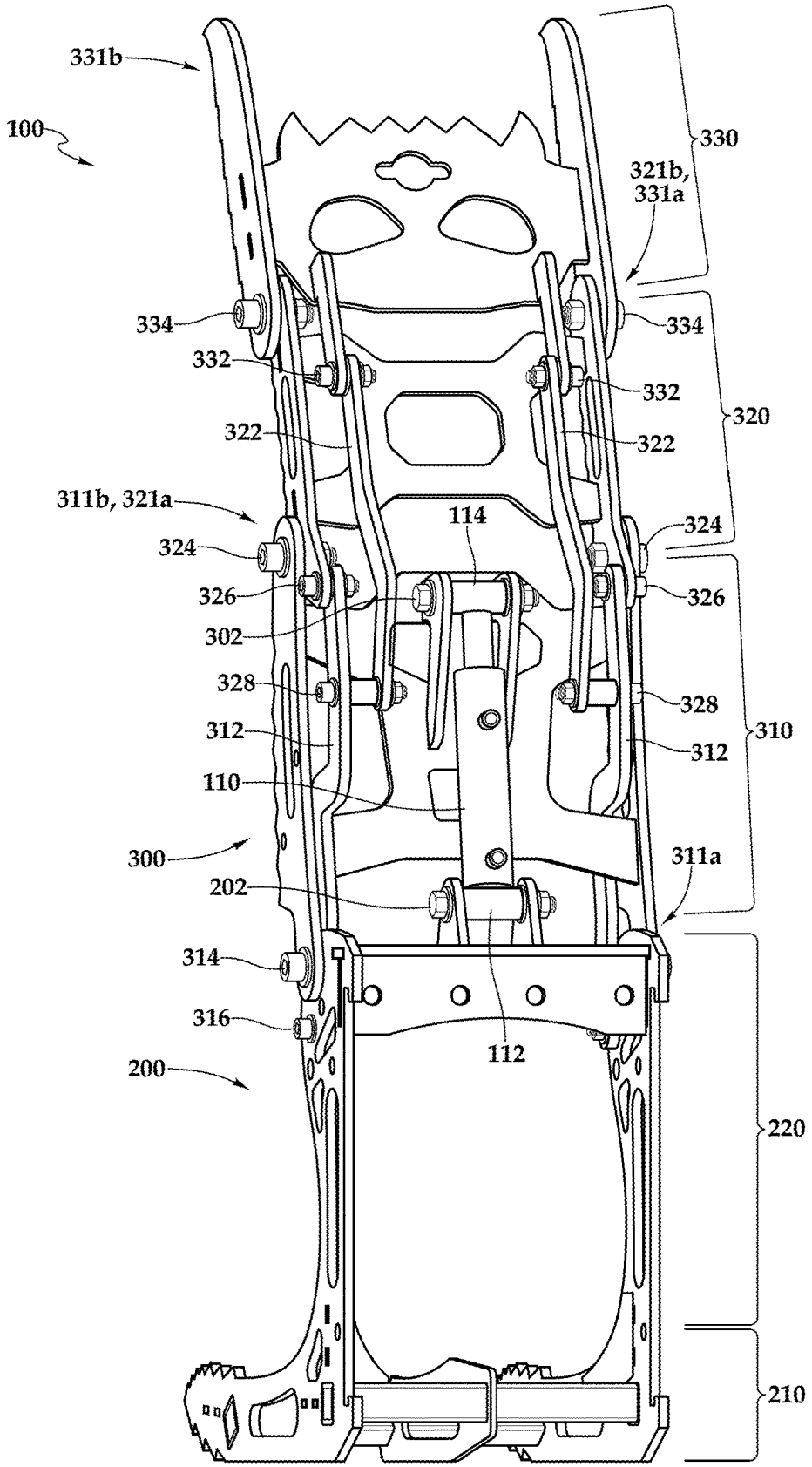
FIG. 7 is a rear perspective view of the example grapple unit in an open configuration.

As may be seen in FIG. 5, the proximal segment 310 and/or the linkages 312 of the articulating assembly 300 can be configured to be pivotably mounted on the fixed assembly 200 at selected ones of multiple available pivot points, including the pivot points 314, 316, a pivot point 315*a*, and a pivot point 315*b*. For example, mounting the proximal segment 310 at the pivot point 314 configures the articulating assembly 300 to actuate at a faster closing speed relative to mounting at the pivot point 315*a*, and mounting at the pivot point 315*a* can configure the articulating assembly 300 to actuate with a greater amount of force relative to mounting at the pivot point 314.

The linear actuator 110 is connected from the fixed assembly 200 to the proximal segment 310 of the articulating assembly 300. When the linear actuator 110 is fully retracted, the articulating assembly 300 is substantially wide open and nearly vertical with respect to the fixed assembly 200. As the linear actuator 110 is extended, the proximal segment 310 of the articulating assembly 300 rotates downward toward the fixed assembly 200. A pair of mechanical linkages 312 are attached to the fixed assembly 200 at a pivot point 316 below a proximal segment pivot point 314 proximal a segment end 311*a* and connects to a segment end 321*a* of the medial segment 320 of the articulating assembly 300 at a pivot point 326 proximal a segment end 311*b*.

As the proximal segment 310 rotates downward, the linkages 312 push upwards on the medial segment 320 behind a pivot point 324 connecting segment end 321*a* of the medial segment 320 to a segment end 311*b* of the proximal segment 310. This causes the medial segment 320 to rotate with respect to the proximal segment 310 about the pivot point 324. A pair of linkages 322 connects to the linkages 312 to the distal segment 330 between a pivot point 328 of the linkages 322 and a pivot point 332 of the distal segment. As motion continues, there is additional rotation of the distal segment 330 with respect to the medial segment 320 about a pivot point 334. When the linear actuator 110 approaches a fully extended configuration, the articulating assembly 300 collapses into a "C" shape, resembling a human fist.

The illustrated design allows for the articulating assembly 300 to be fully opened, without the mechanical restrictions of prior jaw designs. The linkages 312 and 322 collapse the articulating assembly 300 during closing such that both large and small objects can be pulled into the grapple unit assembly 100 and gripped firmly, for example, between the distal segment 330 and the proximal segment 310 of the articulating assembly 300.

Figure 9:
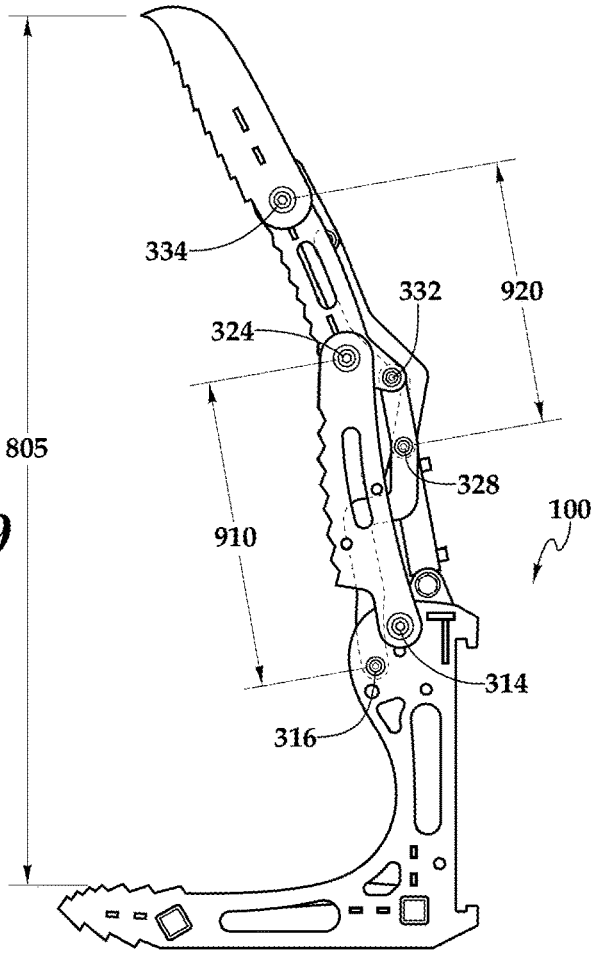
FIG. 9 is a side view of the example grapple unit in an open configuration.
Figure 10:
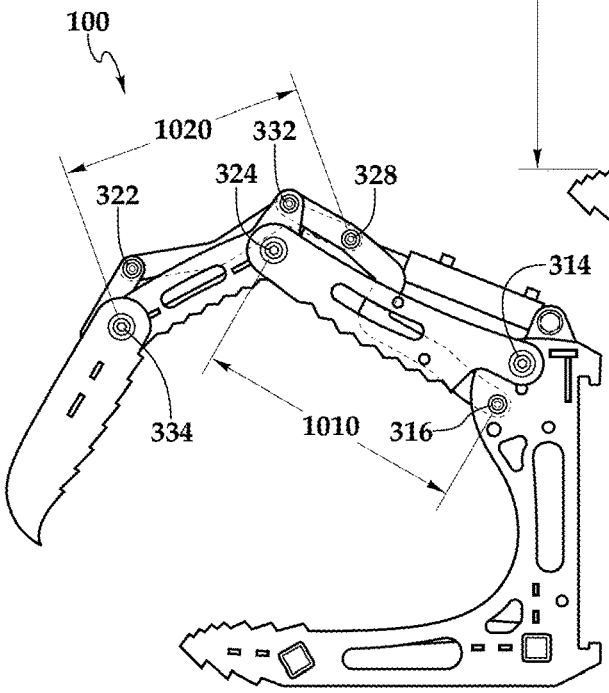
FIG. 10 is a side view of the example grapple unit in a partly open configuration.
Figure 11:
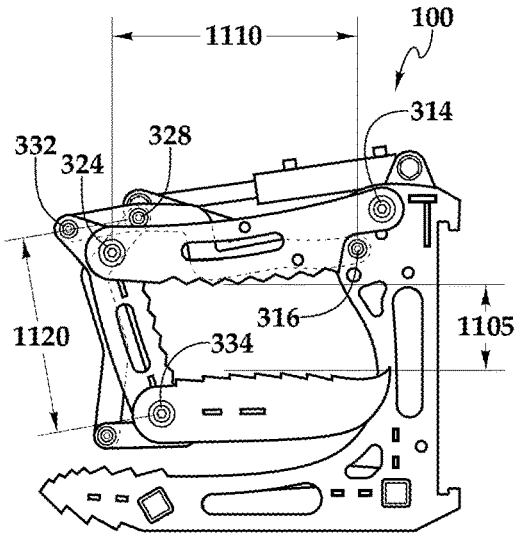
FIG. 11 is a side view of the example grapple unit in a closed configuration.

Referring to FIGS. 9-11, the example grapple unit assembly 100 is shown and described below along with example dimensions. The dimensions shown are for one example configuration, but in other examples other combinations of dimensions can be used.

FIG. 9 is a side view of the example grapple unit assembly 100 in a substantially fully open configuration. In the illustrated example, the grapple unit assembly 100 provides an opening between the fixed assembly 200 and the articulating assembly 300 of about 51 inches, represented by arrow 805. In some embodiments, the illustrated configuration can be achieved by actuating the linear actuator 110 toward a fully retracted configuration. In the illustrated configuration, the pivot point 316 and the pivot point 324 are separated by a distance of about 18.22 inches, represented by arrow 910. In the illustrated configuration, the pivot point 334 and the pivot point 328 are separated by a distance of about 16.16 inches, represented by arrow 920.

FIG. 10 is a side view of the example grapple unit assembly 100 in a partly open configuration. In some embodiments, the illustrated configuration can be achieved by actuating the linear actuator 110 toward a midpoint of its travel. In the illustrated configuration, the pivot point 316 and the pivot point 324 are separated by a distance of about 16.02 inches, represented by arrow 1010. In the illustrated configuration, the pivot point 334 and the pivot point 328 are separated by a distance of about 14.27 inches, represented by arrow 1020.

FIG. 11 is a side view of the example grapple unit assembly 100 in a substantially fully closed configuration. In the illustrated example, the grapple unit assembly 100 provides an opening between the fixed assembly 200 and the articulating assembly 300 of about 5.25 inches, represented by arrow 1105. In some embodiments, the illustrated configuration can be achieved by actuating the linear actuator 110 toward a fully extended configuration. In the illustrated configuration, the pivot point 316 and the pivot point 324 are separated by a distance of about 14.46 inches [NOTE: In FIG. 11 the 14.46 in dimension is pointing to 314. It should be pointing to 316], represented by arrow 1110. In the illustrated configuration, the pivot point 334 and the pivot point 328 are separated by a distance of about 11.68 inches, represented by arrow 1120.

In operations, the linear actuator 110 drives the rotation of the proximal segment 310 with respect to the fixed assembly 200. While that rotation is occurring, the linkages 312 drive the rotation of the medial segment 320 with respect to the proximal segment 310. As the motion continues, the linkages 322 drive the rotation of the distal segment 330 with respect to the medial segment 320. Rotation of the segments 310-330 ceases when one or more of the segments 310-330 securely grip an object or when the linear actuator 110 reaches the full extent of its travel, whichever occurs first.

As stated previously, the linkages 312 drive the rotation of the medial segment 320 with respect to the proximal segment 310. The distance between the pivot points 324 and 314 will remain constant, as will the distance between the pivot points 316 and 332. However, because the pivot point 316 is below (e.g., closer to the interior of the gripping action of the grapple unit assembly 100) the pivot point 314, the distance between the pivot points 316 and 324 will decrease as the proximal segment 310 is rotated toward closure. Since the lengths of the linkages 312 remain constant, they will induce rotation of the medial segment 320 with respect to the proximal segment 310. With this design, a medial segment 320 rotation of nearly 90° is possible with approximately 4" of linear actuator travel.

Similarly, the distance between the pivot point 328 and the pivot point 334 is reduced as the medial segment 320 rotates with respect to the proximal segment 310. This induces up to about 70° rotation of the distal segment 330. As a result, the illustrated example of the grapple unit assembly 100 can open as wide as about 51" and collapse as small as about 5¼". This design can engage with larger piles of payloads and grip significantly smaller objects when compared to traditional sub-compact tractor grapple designs.

Figure 12:
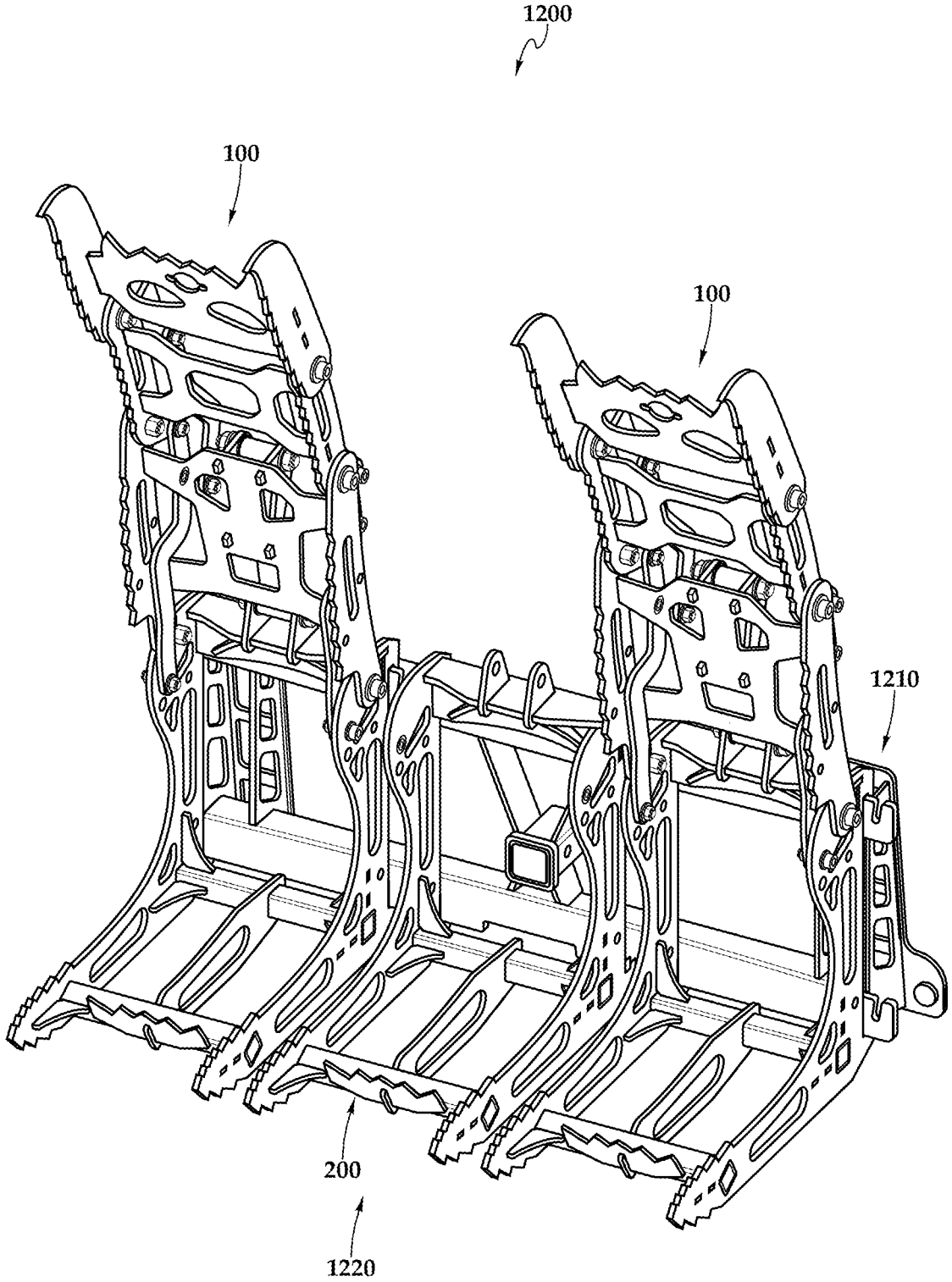
FIG. 12 is a front perspective view of another example grapple unit in an open configuration.

FIG. 12 is a front perspective view of an example grapple assembly 1200 in an open configuration. In the illustrated example, two of the grapple unit assemblies 100 are affixed to a mounting unit 1210 and a rake unit 1220 in a modular manner. In the illustrated example, the rake unit 1220 is a fixed assembly 200 that is not assembled to a corresponding articulating assembly 300. In general, the example grapple unit assemblies 100 can be combined mounting units and other grapple concepts described, for example, in U.S. Pat. No. 10,233,612, or with more traditional loader "direct-attach" grapple designs.

Figure 13A:
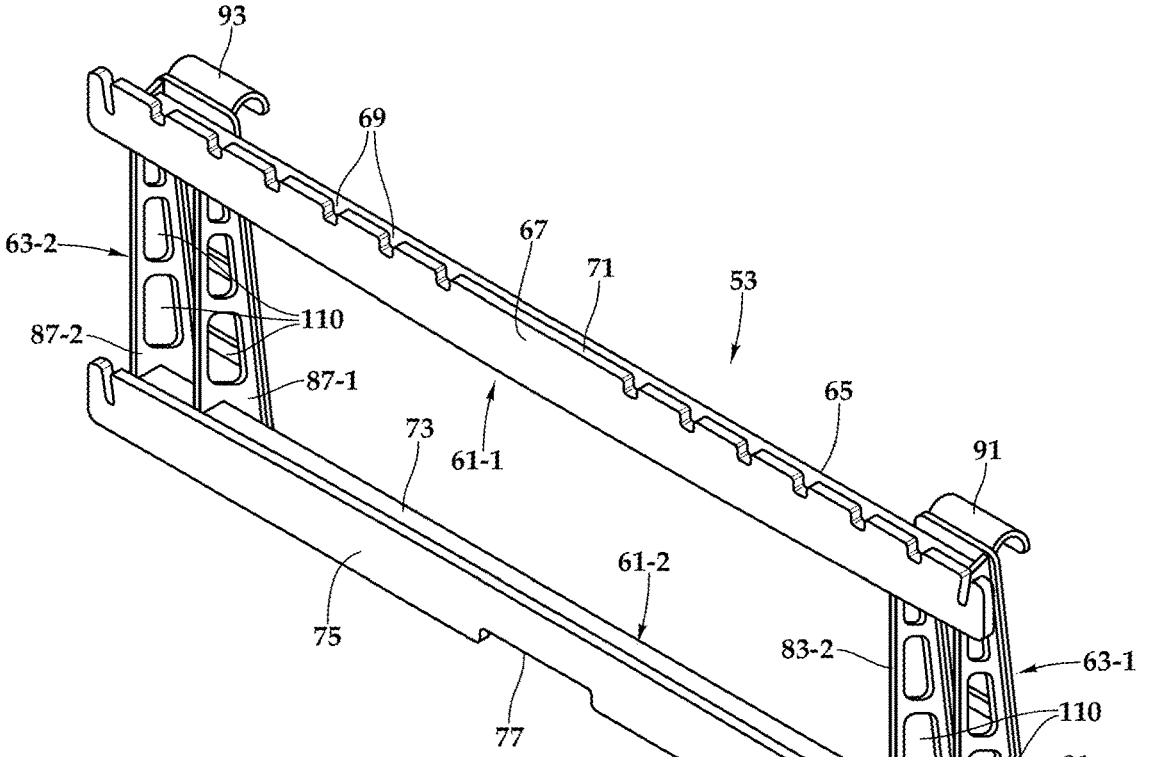
FIG. 13A is a front perspective view of an example mounting unit.
Figure 13B:
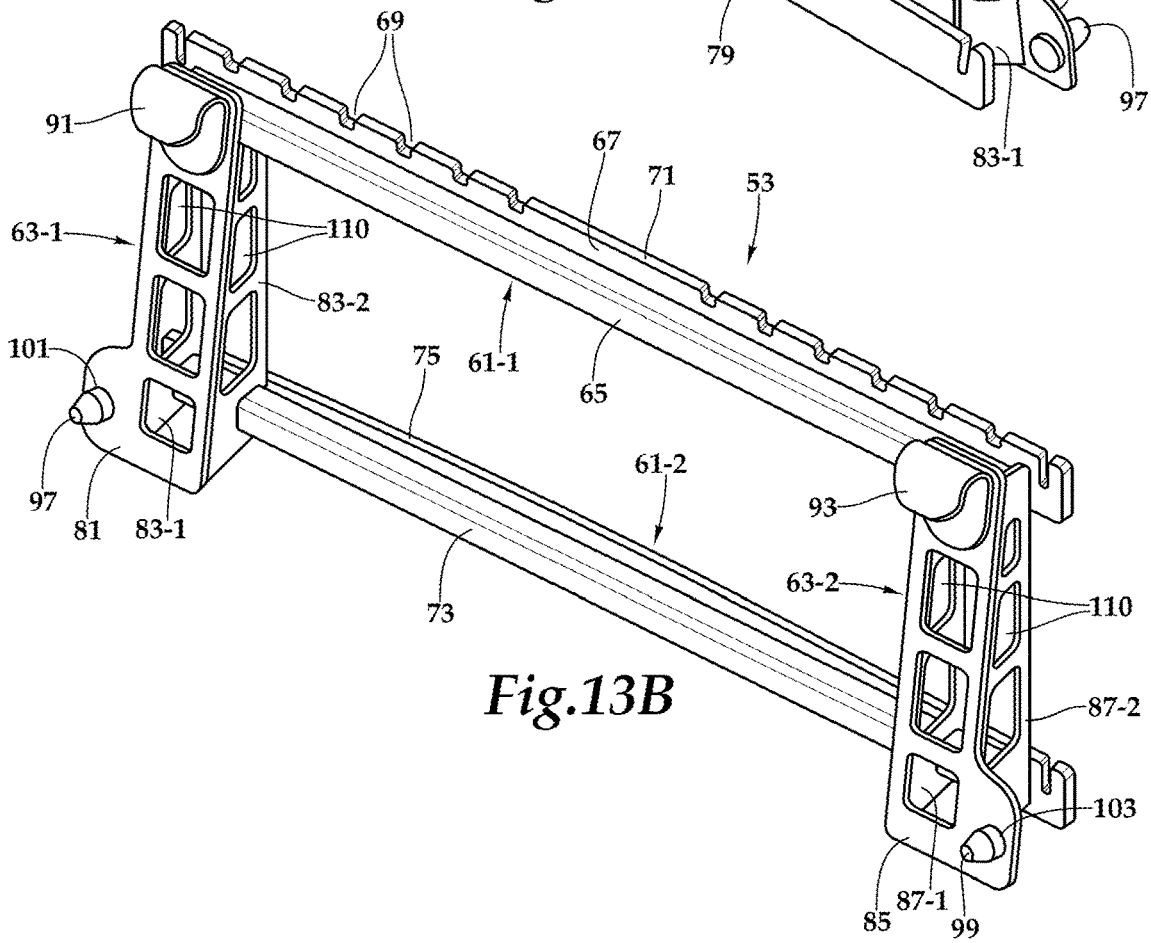
FIG. 13B is a rear perspective view of the example mounting unit.

FIG. 13A is a front perspective view of an example mounting unit 53. FIG. 13B is a rear perspective view of the example mounting unit 53. In some embodiments, the mounting unit can be part of a grapple assembly that includes the mounting unit 53 and the example grapple unit assembly 100. In some embodiments, the mounting unit 53 can be the example mounting unit 1210 of FIG. 12.

The mounting unit 53 shown in the illustrated example includes a pair of mounting rails 61-1 and 61-2 and a pair of mounting brackets 63-1 and 63-2. The mounting rails 61-1 and 61-2 and the mounting brackets 63-1 and 63-2 may collectively form a generally rectangular frame. In some embodiments, the rails 61-1 and 61-2 can be made of a high strength steel or other similarly suitable material. The rails 61-1 and 61-2 are arranged generally parallel to one another. The rail 61-1 is configured to include a rear portion 65 and a front portion 67. In some embodiments, the rear portion 65 and the front portion 67 of the rail 61-1 may be separately fabricated and then fixedly joined to one another by suitable means, such as by welding, fastening, or structural interlocking (e.g., pins, dowels, dovetails). In some embodiments, the rear portion 65 and the front portion 67 of the rail 61-1 may be fabricated as a unitary structure. In some embodiments, the rear portion 65 of rail 61-1 may be fixed by welding or other suitable means to the mounting brackets 63-1 and 63-2. The front portion 65 of the rail 61-1 may be shaped to include a plurality of notches 69 spaced along a top surface 71 thereof.

The rail 61-2 includes a rear portion 73 and a front portion 75. In some embodiments, the rear portion 73 and the front portion 75 of the rail 61-2 may be separately fabricated and then fixedly joined to one another, such as by welding, fastening, or intermeshing. In some embodiments, the rear portion 73 and the front portion 75 of the rail 61-2 may be fabricated as a unitary structure. In some embodiments, the rear portion 73 of the rail 61-2 may be fixed by welding, fastening, or other suitable means to the mounting brackets 63-1 and 63-2. The front portion 75 of the rail 61-2 includes a notch 77 disposed along a bottom surface 79 thereof.

In some embodiments, the brackets 63-1 and 63-2 can be made of a high strength steel or other similarly suitable material. The brackets 63-1 and 63-2 are arranged generally parallel to one another and generally perpendicularly relative to the rails 61-1 and 61-2. The bracket 63-1 includes a rear portion 81 and a pair of side portions 83-1 and 83-2. In a similar fashion, the bracket 63-2 includes a rear portion 85 and a pair of side portions 87-1 and 87-2. In some embodiments, the brackets 63-1 and 63-2 may be fabricated by separately forming the respective rear and side portions thereof and then by joining the rear and side portions together by suitable means, such as by welding or fastening. In some embodiments, the respective rear and side portions of each of brackets 63-1 and 63-2 may be fabricated as a unitary structure. A first hook 91 is affixed to the rear surface of the rear portion 81 of the bracket 63-1, and a second hook 93 a affixed to the rear surface of the rear portion 85 of the bracket 63-2. The hooks 91 and 93 may be appropriately shaped to matingly fit over the top ends of the mounts of a suitably constructed loader boom, for example, the mounts 21-1 and 21-2, respectively, of the loader boom 17, the mounts 21-1 and 21-2 being configured for use in mechanically coupling the brackets 63-1 and 63-2 to the mounts of the loader boom. It is to be understood that, although the hooks 91 and 93 are shown in the illustrated example as being separately constructed from the rear portions 81 and 85, respectively, the hooks 91 and 93 may be integrally formed with the rear portions 81 and 85, respectively. A first pin 97 is provided on the rear portion 81 of the bracket 63-1 and projects rearwardly therefrom, and a second pin 99 is provided on the rear portion 85 of the bracket 63-2 and projects rearwardly therefrom. The pins 97 and 99 are appropriately dimensioned for insertion through the pin holes in the mounts of a suitably constructed loader boom, such as, for example, pin holes 27-1 and 27-2, respectively, of the loader boom 17, the pin holes 27-1 and 27-2 being configured for use in mechanically coupling the brackets 63-1 and 63-2 to the mounts of the loader boom. The pin 97 is shaped to include a transverse through-hole 101, and the pin 99 is similarly shaped to include a transverse through-hole 103. Each of the through-holes 101 and 103 may be used to receive a cotter pin (not shown) or the like for retaining the pins 97 and 99 in the mounts of the loader boom. In some embodiments, the pins 97 and 99 may be integrally formed with rear portions 81 and 85, respectively, or, as shown in the illustrated example, the pins 97 and 99 may be fabricated separately from the rear portions 81 and 85, respectively, and then may be joined thereto by suitable means, such as by welding or fastening.

Each of the side portions 83-1 and 83-2 of the bracket 63-1 and each of the side portions 87-1 and 87-2 of the bracket 63-2 are affixed to the mounting rails 61-1 and 61-2. In this manner, when the mounting unit 53 is mounted on the loader boom of a tractor, the rails 61-1 and 61-2 are disposed generally horizontally relative to the ground, and the side portions 83-1 and 83-2 are disposed generally perpendicularly relative to the ground. One or more voids 111 of various shapes and sizes are provided in the brackets 63-1 and 63-2 to reduce the weight thereof.

In some embodiments, the mounting unit 53 can be provided in a substantially or fully assembled state. The mounting unit 53 may, however, be removably mounted on the loader boom of a tractor. The mounting of the mounting unit 53 on the loader boom of a tractor may be accomplished by matingly positioning the hooks 91 and 93 over and around the respective top ends of the mounts of the loader boom, such as, for example, the mounts 21-1 and 21-2 of the loader boom 17, and then by inserting the pins 97 and 99 through the pin holes of the loader boom, such as, for example, the pin holes 27-1 and 27-2 of the loader boom 17. Cotter pins or the like then may be used to retain the pins 97 and 99 in place in the mounts. To remove the mounting unit 53 from the loader boom, one may reverse the sequence of steps described above.

The mounting unit 53 may be used with a loader boom, such as, for example, the loader boom 17. In some embodiments, the mounting unit can provide for modular in construction of grapple and other loader assemblies, such as grapple unit assemblies 100, rake units 1220, buckets (not shown), and combinations of these another implements. As a result, a great number of different combinations of the grapple unit assemblies 100 and other assemblies may be mounted on the mounting unit 53, all such combinations coming within the scope of the present disclosure. In addition, it is to be understood that, although the mounting unit 53 is shown in the illustrated example as having space for three grapple unit assemblies 100 or rake units 1220, the mounting unit 53 may be modified so that any appropriate number of grapple unit assemblies 100, rake units 1220, or combinations of these and other implements may be used. In some embodiments, a grapple unit can include a mounting unit that is permanently affixed to the grapple unit. In some embodiments, a grapple unit can include features that permit modular assembly of one or more grapple units and mounting units.

Figure 14:
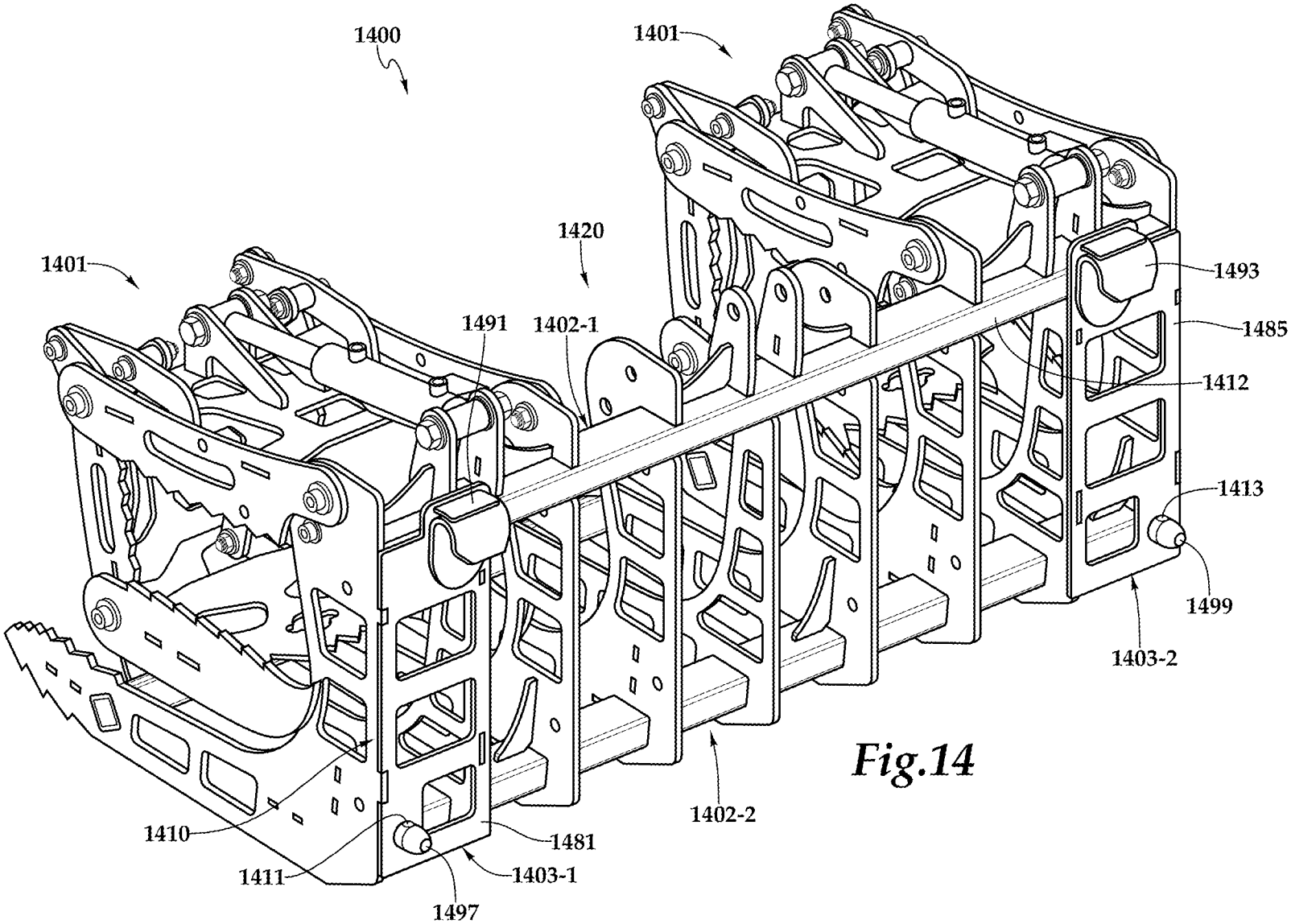
FIG. 14 is a rear perspective view of an example grapple assembly 1400 in a closed configuration.

FIG. 14 is a rear perspective view of an example grapple assembly 1400 in a closed configuration. In the illustrated example, two example grapple units 1401 are affixed to components 1412 of another example mounting unit 1410 and an example rake unit 1420 in a modular manner. In some embodiments, the grapple units 1401 can be examples of the grapple unit assembly 100 that has been modified for modular, integral, or permanent inclusion of and fixation to the mounting unit 1410.

The grapple unit 1401 shown in the illustrated example includes a pair of mounting rails 1402-1 and 1402-2 and a pair of mounting brackets 1403-1 and 1403-2. The mounting rails 1402-1 and 1402-2 and the mounting brackets 1403-1 and 1403-2 may collectively form a generally rectangular frame. In some embodiments, the rails 1402-1 and 1402-2 can be made of a high strength steel or other similarly suitable material. The rails 1402-1 and 1402-2 are arranged generally parallel to one another.

In some embodiments, the brackets 1403-1 and 1403-2 can be made of a high strength steel or other similarly suitable material. In some embodiments, the brackets 1403-1 and 1403-2 can be formed integrally with the grapple units 1401. In some embodiments, the brackets 1403-1 and 1403-2 can be fastened, welded, or otherwise assembled to the grapple units 1401. The brackets 1403-1 and 1403-2 are arranged generally parallel to one another and generally perpendicularly relative to the rails 1402-1 and 1402-2. The bracket 1403-1 includes a rear portion 1481, and the bracket 1403-2 includes a rear portion 1485.

A first hook 1491 is affixed to the rear surface of the rear portion 1481 of the bracket 1403-1, and a second hook 1493 a affixed to the rear surface of the rear portion 1485 of the bracket 1403-2. The hooks 1491 and 1493 may be appropriately shaped to matingly fit over the top ends of the mounts of a suitably constructed loader boom, for example, the mounts 21-1 and 21-2, respectively, of the loader boom 17, the mounts 21-1 and 21-2 being configured for use in mechanically coupling the brackets 1403-1 and 1403-2 to the mounts of the loader boom. It is to be understood that, although the hooks 1491 and 1493 are shown in the illustrated example as being separately constructed from the rear portions 1481 and 1485, respectively, the hooks 1491 and 1493 may be integrally formed with the rear portions 1481 and 1485, respectively. A first pin 1497 is provided on the rear portion 1481 of the bracket 1403-1 and projects rearwardly therefrom, and a second pin 1499 is provided on the rear portion 1485 of the bracket 1403-2 and projects rearwardly therefrom. The pins 1497 and 1499 are appropriately dimensioned for insertion through the pin holes in the mounts of a suitably constructed loader boom, such as, for example, pin holes of the loader boom 17, the pin holes being configured for use in mechanically coupling the brackets 1403-1 and 1403-2 to the mounts of the loader boom. The pin 1497 is shaped to include a transverse through-hole 1411, and the pin 1499 is similarly shaped to include a transverse through-hole 1413. Each of the through-holes 1411 and 1413 may be used to receive a cotter pin (not shown) or the like for retaining the pins 1497 and 1499 in the mounts of the loader boom. In some embodiments, the pins 1497 and 1499 may be integrally formed with rear portions 1481 and 1485, respectively, or, as shown in the illustrated example, the pins 1497 and 1499 may be fabricated separately from the rear portions 1481 and 1485, respectively, and then may be joined thereto by suitable means, such as by welding or fastening.

The mounting unit 1410 is configured to be removably mounted on the loader boom of a tractor. The mounting of the mounting unit 1410 on the loader boom of a tractor may be accomplished by matingly positioning the hooks 1491 and 1493 over and around the respective top ends of the mounts of the loader boom, such as, for example, the mounts 21-1 and 21-2 of the loader boom 17, and then by inserting the pins 1497 and 1499 through the pin holes of the loader boom. Cotter pins or the like then may be used to retain the pins 1497 and 1499 in place in the mounts. To remove the mounting unit 1410 from the loader boom, one may reverse the sequence of steps described above.

The mounting unit 1410 may be used with a loader boom, such as, for example, the loader boom 17. In some embodiments, the mounting unit can provide for modular in construction of grapple and other loader assemblies, such as grapple units 1401, rake units 1220, buckets (not shown), and combinations of these another implements. As a result, a great number of different combinations of the grapple unit assemblies 100 and other assemblies may be mounted on the mounting unit 1410, all such combinations coming within the scope of the present disclosure. In addition, it is to be understood that, although the mounting unit 1410 is shown in the illustrated example as having space for three grapple units 1401 or rake units 1220, the mounting unit 1410 may be modified so that any appropriate number of grapple units 1401, rake units 1220, or combinations of these and other implements may be used. In some embodiments, a grapple unit can include a mounting unit that is permanently affixed to the grapple unit. In some embodiments, a grapple unit can include features that permit modular assembly of one or more grapple units and mounting units.

Figure 15:
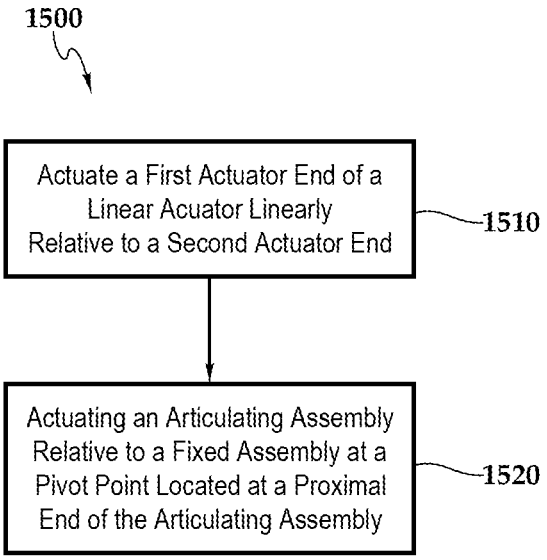
FIG. 15 is a flow diagram of an example process for actuating a grapple unit.

FIG. 15 is a flow diagram of an example process 1500 for actuating a grapple assembly. In some implementations, the process 1500 can be performed using the example grapple unit assembly 100 of FIGS. 3-10 or the example grapple unit 1401 of FIG. 14.

At 1510, a first actuator end of a linear actuator is actuated linearly relative to a second actuator end. For example, the linear actuator 110 can be actuated to move the actuator end 112 closer to and further away from the actuator end 114.

At 1520, an articulating assembly is actuated by the linear actuator relative to a fixed assembly at a pivot point located at a proximal end of the articulating assembly, pivotably coupling the articulating assembly to the fixed assembly, the first actuator end being pivotably coupled to the fixed assembly and the second actuator end being pivotably coupled to an articulation connection point of the articulating assembly. For example, the articulating assembly 300 can be caused to open and close relative to the fixed assembly 200.

In some implementations, actuating an articulating assembly relative to a fixed assembly at a pivot point located at a proximal end of the articulating assembly also includes actuating, by the linear actuator, a proximal segment relative to the fixed assembly, the proximal segment comprising the actuation point, the pivot point at a first segment end, and a second pivot point at a second segment end opposite the first segment end, and actuating a medial segment relative to the proximal segment and the fixed segment, wherein the medial segment is pivotably coupled to the second pivot point at a third segment end and extending to a fourth segment end. For example, the linear actuator 110 can cause the proximal segment 310 to pivot relative to the fixed assembly 200.

In some implementations, actuating a medial segment relative to the proximal segment can include actuating, by the medial segment, a first linkage pivotably coupled to the fixed assembly at a first linkage end and pivotably coupled to the medial segment at a second linkage end opposite the first linkage end. For example, movement of the medial segment 320 can urge movement of the linkages 312.

In some implementations, actuating an articulating assembly relative to a fixed assembly at a pivot point located at a proximal end of the articulating assembly can include actuating, by a second linkage, a distal segment having a fifth segment end pivotably coupled to a third pivot point at the fourth segment end, and extending to a sixth segment end opposite the fifth segment end, and actuating, by the first linkage, the second linkage, wherein the second linkage is pivotably coupled to the first linkage at a third linkage end and pivotably coupled to the distal segment at a fourth linkage end opposite the first linkage end. For example, the linkages 312 can actuate the linkages 322.

In some implementations, the process 1500 can also include removably affixing the fixed assembly to a tractor loader boom of a tractor, and coupling the linear actuator to a controllable power source of the tractor. For example, the example grapple unit assembly 100 can be removably affixed to the example mounting unit 53 of FIGS. 13A-13B, or to the example mounting unit 1210 of FIG. 12, or to the example mounting unit 1410 of FIG. 14, and the mounting units 53, 1210, and/or 1410 can be removably affixed to the loader boom 17 of the tractor assembly 11.

In some implementations, the process 1500 can also include controllably providing power from a power source of a tractor to the linear actuator, wherein actuation of the linear actuator is based on receiving power controllably provided from the power source of the tractor. For example, the linear actuator 110 can be a hydraulic piston that can be connected to a controllable hydraulic power source of the tractor assembly 11. In another example, the linear actuator 110 can be an electromechanical actuator that can be connected to a controllable electrical power source of the tractor assembly 11.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A grapple assembly comprising:

a grapple unit comprising:

a fixed assembly;

an articulating assembly having:

a pivot point located at a proximal end of the articulating assembly, pivotably coupling the articulating assembly to the fixed assembly; and an articulation connection point distal to the pivot point along the articulating assembly; the articulating assembly comprising:

a proximal segment comprising the articulation connection point, the pivot point at a first segment end, and a second pivot point at a second segment end opposite the first segment end;

a medial segment pivotably coupled to the second pivot point at a third segment end and extending to a fourth segment end; and a first linkage pivotably coupled to the fixed assembly at a first linkage end and pivotably coupled to the medial segment at a second linkage end opposite the first linkage end; and a linear actuator having a first actuator end and a second actuator end configured to move linearly relative to the first actuator end, the first actuator end being pivotably coupled to the fixed assembly and the second actuator end being pivotably coupled to the articulation connection point, and configured to actuate the articulating assembly relative to the fixed assembly.

2. The grapple assembly of claim 1, wherein the articulating assembly further comprises:

a distal segment having a fifth segment end pivotably coupled to a third pivot point at the fourth segment end, and extending to a sixth segment end opposite the fifth segment end; and a second linkage pivotably coupled to the first linkage at a third linkage end and pivotably coupled to the distal segment at a fourth linkage end opposite the first linkage end.

3. The grapple assembly of claim 1, wherein the articulating assembly is configured to be pivotably mounted on the fixed assembly at one of a first pivot point and a second pivot point, wherein mounting at the first pivot point configures the articulated assembly to actuate at a faster closing speed relative to mounting at the second pivot point, and mounting at the second pivot point configures the articulated assembly to actuate with a greater amount of force relative to mounting at the first pivot point.

4. The grapple assembly of claim 1, further comprising a mounting unit removably affixed to the grapple unit and configured to removably mount the grapple unit on a tractor loader boom.

5. The grapple assembly of claim 1, further comprising a mounting unit integrally formed with the grapple unit and configured to removably mount the grapple unit on a tractor loader boom.

6. The grapple assembly of claim 4 wherein the mounting unit comprises a frame, the frame comprising first and second rails and first and second brackets, the first and second brackets interconnecting the first and second rails and having structure complementary to the tractor loader boom, the grapple unit being removably mounted on the first and second rails.

7. The grapple assembly of claim 1, wherein the fixed assembly comprises a first portion and a second portion forming an L-shape, and the articulating assembly is pivotally mounted on the second portion of the fixed assembly at an end of the L-shape.

8. A method for grappling comprising:

actuating a first actuator end of a linear actuator linearly relative to a second actuator end of the linear actuator; and actuating, by the linear actuator, an articulating assembly relative to a fixed assembly at a pivot point located at a proximal end of the articulating assembly, pivotably coupling the articulating assembly to the fixed assembly, the first actuator end being pivotably coupled to the fixed assembly and the second actuator end being pivotably coupled to an articulation connection point of the articulating assembly, wherein actuating the articulating assembly further comprises:

actuating, by the linear actuator, a proximal segment relative to the fixed assembly, the proximal segment comprising the articulation connection point, the pivot point at a first segment end, and a second pivot point at a second segment end opposite the first segment end;

actuating a medial segment relative to the proximal segment and the fixed assembly, wherein the medial segment is pivotably coupled to the second pivot point at a third segment end and extending to a fourth segment end; and actuating, by the medial segment, a first linkage pivotably coupled to the fixed assembly at a first linkage end and pivotably coupled to the medial segment at a second linkage end opposite the first linkage end.

9. The method of claim 8, wherein actuating an articulating assembly relative to a fixed assembly at a pivot point located at a proximal end of the articulating assembly further comprises:

actuating, by a second linkage, a distal segment having a fifth segment end pivotably coupled to a third pivot point at the fourth segment end, and extending to a sixth segment end opposite the fifth segment end; and actuating, by the first linkage, the second linkage, wherein the second linkage is pivotably coupled to the first linkage at a third linkage end and pivotably coupled to the distal segment at a fourth linkage end opposite the first linkage end.

10. The method of claim 8, further comprising removably affixing the fixed assembly to a tractor loader boom of a tractor, and coupling the linear actuator to a controllable power source of the tractor.

11. The method of claim 8, further comprising controllably providing power from a power source of a tractor to the linear actuator, wherein actuation of the linear actuator is based on receiving power controllably provided from the power source of the tractor.

* * * * *